US008763923B2

(12) United States Patent
Cox et al.

(10) Patent No.: US 8,763,923 B2
(45) Date of Patent: Jul. 1, 2014

(54) RAILWAY RAIL FASTENING APPARATUS

(75) Inventors: Stephen John Cox, Richmond (GB); John Phillip Porrill, Godalming (GB); Anthony Adedipe, Coulsdon (GB); Nicholas Lloyd, Middlesex (GB)

(73) Assignee: Pandrol Limited, Addlestone, Surrey (GB)

( * ) Notice: Subject to any disclaimer, the term of this patent is extended or adjusted under 35 U.S.C. 154(b) by 148 days.

(21) Appl. No.: 13/512,826

(22) PCT Filed: Dec. 3, 2010

(86) PCT No.: PCT/EP2010/068891

§ 371 (c)(1),
(2), (4) Date: Aug. 2, 2012

(87) PCT Pub. No.: WO2011/076543

PCT Pub. Date: Jun. 30, 2011

(65) Prior Publication Data

US 2012/0318881 A1 Dec. 20, 2012

(30) Foreign Application Priority Data

Dec. 22, 2009 (GB) ..... 0922324.9

(51) Int. Cl.
*E01B 9/28* (2006.01)
*E01B 9/66* (2006.01)

(52) U.S. Cl.
USPC ..... 238/343; 238/351

(58) Field of Classification Search
CPC ..... E01B 9/28; E01B 9/36; E01B 9/66
USPC ..... 238/338, 340, 342, 343, 345, 346, 351, 238/353, 354, 361
See application file for complete search history.

(56) References Cited

U.S. PATENT DOCUMENTS

| | | | | |
|---|---|---|---|---|
| 1,065,797 | A * | 6/1913 | Gebhardt | 238/304 |
| 2,787,421 | A * | 4/1957 | Krabbendam | 238/281 |
| 3,987,962 | A | 10/1976 | Robbins | |
| 5,022,584 | A * | 6/1991 | Sherrick | 238/282 |

(Continued)

FOREIGN PATENT DOCUMENTS

| | | |
|---|---|---|
| DE | 43 17 097 A1 | 11/1994 |
| EP | 0 376 594 A2 | 7/1990 |

(Continued)

OTHER PUBLICATIONS

Great Britain's Intellectual Property Office's Mar. 11, 2010 Search Report corresponding to Application No. GB0922324.9.

(Continued)

*Primary Examiner* — Zachary Kuhfuss
(74) *Attorney, Agent, or Firm* — Husch Blackwell LLP

(57) ABSTRACT

A railway rail fastening apparatus has a baseplate for receiving a railway rail to be fastened thereto and baseplate securing elements for securing the baseplate to a baseplate seat area of a concrete railway foundation. The baseplate securing elements carry first and second fastening assemblies configured for location on the concrete rail foundation on opposite sides of the baseplate seat area. Each of the first and second fastening assemblies including fixing member having a first part that extends from the baseplate member for retention within the concrete rail foundation. Only the fixing member of one fastening assembly includes a screw-threaded fastener.

19 Claims, 5 Drawing Sheets

(56) References Cited

U.S. PATENT DOCUMENTS

| | | | | |
|---|---|---|---|---|
| 5,520,330 | A * | 5/1996 | Brown et al. | 238/351 |
| 7,648,080 | B2 * | 1/2010 | Hohne et al. | 238/351 |
| 7,845,578 | B2 * | 12/2010 | Cox et al. | 238/349 |
| 7,954,727 | B2 * | 6/2011 | Cox et al. | 238/343 |
| 7,992,796 | B2 * | 8/2011 | Bednarczyk | 238/264 |
| 2003/0085294 | A1 | 5/2003 | Rada | |
| 2009/0045265 | A1 * | 2/2009 | Cox et al. | 238/343 |
| 2009/0308943 | A1 * | 12/2009 | Wirthwein et al. | 238/310 |

FOREIGN PATENT DOCUMENTS

| | | | |
|---|---|---|---|
| GB | 1 376 929 | | 12/1974 |
| GB | 1 468 879 | | 3/1977 |
| KR | 20030061271 | A | 7/2003 |
| SU | 1470826 | A1 | 4/1989 |
| WO | WO 93/12296 | | 6/1993 |
| WO | WO 01/38642 | A1 | 5/2001 |
| WO | WO 2007/096620 | A1 | 8/2007 |

OTHER PUBLICATIONS

Great Britain's Intellectual Property Office's Apr. 6, 2010 Search Report corresponding to Application No. GB0922324.9.

PCT International Search Report dated Mar. 11, 2011 corresponding to International Application No. PCT/EP2010/068891.

* cited by examiner

RAILWAY RAIL FASTENING APPARATUS

The present invention relates to railway rail fastening apparatus, particularly, but not exclusively, for use on concrete slab track.

Railway rail fastening apparatus suitable for use on concrete slab track in urban and/or underground railway systems is generally required to have a lower stiffness than would be the case for fastening apparatus used on ballasted track, so as to compensate for the loss of resilience otherwise provided by the ballast. One such rail fastening apparatus comprises a baseplate provided with rail fastening shoulders on either side of a rail seat area of the baseplate, a cushioning/insulating rail pad provided on the rail seat area, and a baseplate pad provided between the concrete rail foundation and the baseplate. The bulk of the resilience in the system is provided by the baseplate pad. The baseplate itself must be anchored to the slab track and this is usually achieved in the prior art by means of screw-threaded fasteners, such as bolts or screwspikes, passing through holes in the baseplate.

In a baseplate having through holes, a lateral load will be shared between bolts at either end of the baseplate. The load may not be evenly shared, as there has to be a small clearance to ensure that everything can be fitted together, but on the field side of the plate it will generally apply an outward lateral load to the side of the bolts that is nearest the rail (which will cause the bolts to bend away from the rail) and on the gauge side of the plate it will push on the side of the bolts furthest away from the rail (which will cause the bolts to bend towards the rail). This type of through-bolted assembly has several problems. Firstly, as the bolts are round the lateral force has to be transmitted through a line contact, so even though the loads are shared these moving line contacts wear quickly. Secondly, typically the tops of the bolts project above the height of the clips retaining the rail by a significant amount, which is a particular problem with clips which are driven onto the rail in a lateral direction, such as the "switch-on/switch-off" clips disclosed in EP0619852B. This problem can be ameliorated at the cost of making the baseplate much bigger so as to allow sufficient room between the shoulders and the bolts, but the bolt assemblies are still liable to damage by track machinery used to install and extract laterally-driven clips. Furthermore, because the bolts pass through a resilient baseplate pad, they are subject to high levels of lateral bending loads and can easily fail in fatigue if not carefully designed. Most of these problems could be avoided by employing a clamp designed to overhang the edge of the baseplate so as to hold it down, which clamp would itself be rigidly bolted down, have a much lower profile so as to allow a clip to slide back and forth above it, and have a flat bearing face for reacting lateral loads.

However, this arrangement would also have problems. When a lateral load component is applied to the baseplate in either direction, this tends to apply a compressive force across the connection between the baseplate and the slab track at a first end of the baseplate and a tensile force across the second end. If the connection is a simple insulating spacer, as is desirable to keep cost down, rather than some more complex arrangement whereby the connection is bonded to or interlinked with the baseplate, then the tensile force at the second end of the baseplate creates a gap across which no force is transmitted. Consequently, all the applied lateral force is in fact transmitted to the slab track through the connection at the first end of the baseplate. As far as reaction of lateral loads is concerned, the baseplate is therefore effectively fixed down with only one bolt, i.e. that at the first end of the baseplate. However, in practice this is not enough. Typically, in an assembly having effectively only one bolt, that bolt would be overstressed by lateral bending loads. Furthermore, as mentioned above, the nature of bolts is that they are round, so the lateral force has to be transmitted through a vertical line contact. As a result, the bolt, or a clamp that is being held down by the bolt, will break if this arrangement is used at the compressive (always the field side) end of the baseplate.

In an alternative arrangement, the baseplate is held down by resilient rail clips retained by shoulders cast into the concrete slab track, of the type used to hold down the rail itself. Shoulders are much stronger than bolts and can have flat bearing faces to react lateral loads, thereby avoiding the problem of breakage. However, the provision of shoulders and clips, and associated insulators, to hold down the baseplate, in addition to those required to hold down the rail, increases the cost and complexity of the apparatus.

Moreover, it is desirable to provide apparatus which can provide for vertical height adjustment on concrete slab track. Generally, apparatus capable of vertical height adjustment must be more complex compared to arrangements in which no vertical height adjustment is possible.

According to a first aspect of the present invention there is provided railway rail fastening apparatus comprising a baseplate for receiving a railway rail to be fastened thereto and baseplate securing means for securing the baseplate to a baseplate seat area of a concrete railway foundation, the baseplate securing means comprising first and second fastening assemblies configured for location on the concrete rail foundation on opposite sides of the baseplate seat area, each fastening assembly comprising clamping means configured such that a part of the clamping means can be arranged so as to overlie part of the baseplate, when the baseplate is supported by the concrete rail foundation and is located in the baseplate seat area thereof, each of the first and second fastening assemblies further comprising fixing means having a first part configured for retention within the concrete rail foundation and a second part configured for location above the rail foundation and for engaging the said clamping means; wherein, of the fixing means of the first and second fastening assemblies, only the fixing means of the second fastening assembly consists of a screw-threaded fastener.

The fixing means of the first fastening assembly preferably has a bearing part having a planar load bearing face through which load is transmitted from the baseplate to the fixing means of the first fastening assembly when the apparatus is in use.

According to a second aspect of the present invention there is provided railway rail fastening apparatus comprising a baseplate for receiving a railway rail to be fastened thereto, and baseplate securing means for securing the baseplate to a baseplate seat area of a concrete railway foundation, the baseplate securing means comprising first and second fastening assemblies configured for location on opposite sides of the baseplate seat area, each fastening assembly comprising clamping means configured such that an overhang part of the clamping means can be arranged so as to overlie part of the baseplate when the baseplate is supported by the concrete rail foundation and is located in the baseplate seat area thereof, wherein: the first fastening assembly further comprises fixing means having a first part configured for retention within the concrete rail foundation and a second part configured for location above the rail foundation which is adapted to retain the clamping means such that, when the apparatus is in use, a bearing part of the clamping means of the first fastening assembly is interposed between an upright face of the second part of the fixing means of the first fastening assembly and an upright end face of the baseplate; and there are interfaces between the bearing part of the clamping means and the upright end face of the baseplate and between the bearing part of the clamping means and the upright face of the second part of the fixing means through which load is transmitted from the baseplate to the fixing means of the first fastening assembly when the apparatus is in use and these interfaces are planar.

Any upward vertical loading applied to the baseplate in the first or second aspect of the invention is first transmitted through the clamping means of the first/second fastening assembly, rather than directly into the fixing means, thereby reducing the risk of damaging the fixing means and preferably restricting the extent of any unforeseen damage to the clamping means alone, which is a separate, replaceable part. This is particularly advantageous when the fixing means of the first fastening assembly is a cast-in shoulder.

The clamping means may be made of plastics material. The resilience of plastics material gives the clamping means some flexibility, which can further reduce the effect of any upward vertical loading applied to the baseplate.

The apparatus may further comprise at least one additional clamping means for the first fastening assembly having an overhang part at a different height to the first-mentioned clamping means for installation in the apparatus in place of the first-mentioned clamping means.

The clamping means of the first fastening assembly may comprise a clamping part, a first intermediate portion for location between the clamping part and an interior portion of the second part of the fixing means and a second intermediate portion for location between the clamping part and the baseplate. At least one additional clamping part may be provided, having an overhang part at a different height to the first-mentioned clamping part, for installation in the apparatus in place of the first-mentioned clamping means. In this case, the apparatus may also further comprise at least one additional second intermediate portion, at least one dimension of which differs from that of the first-mentioned second intermediate portion, for installation in the apparatus in place of the first-mentioned second intermediate portion.

The fixing means of the first fastening assembly preferably consists of a shoulder.

Reference will now be made, by way of example, to the accompanying drawings, in which:

FIG. 10 shows a plan view of the apparatus and FIG. 1D shows a perspective view of the apparatus from above;

Figure 3E:
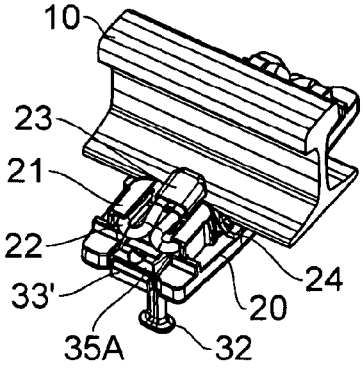
Figure 3D:
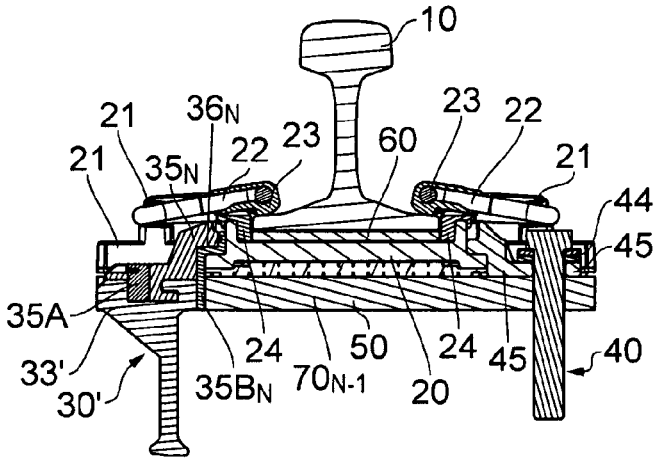
Figure 3A:
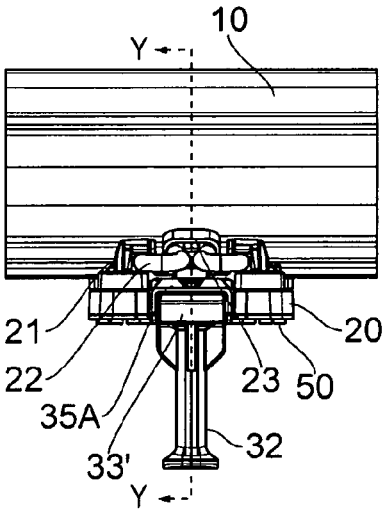
Figure 3C:
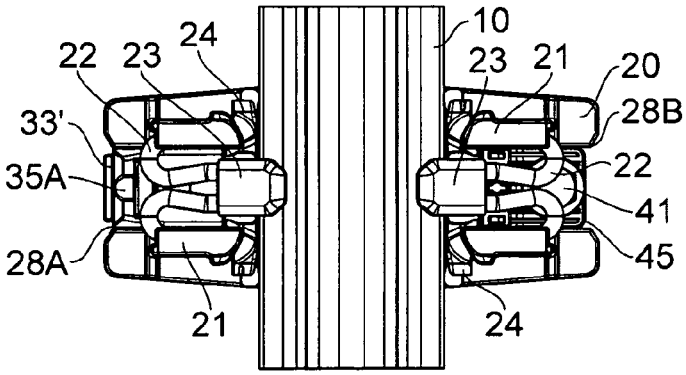
Figure 3B:
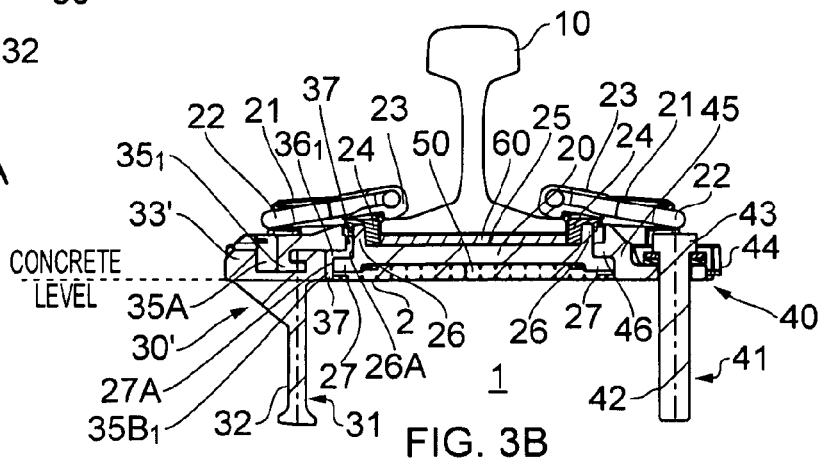
Figure 4D:
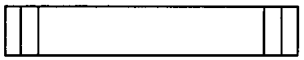
Figure 4C:
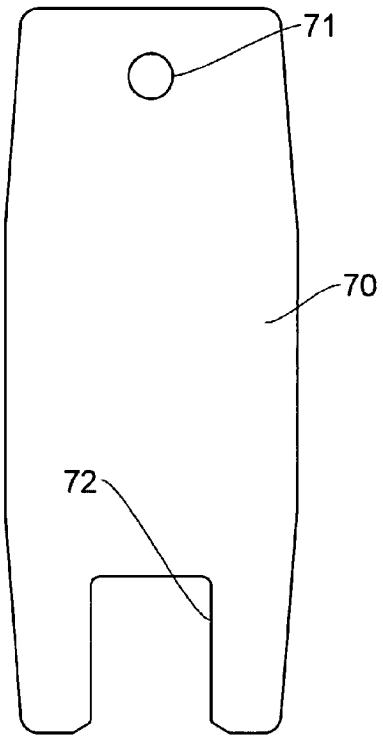
Figure 4B:
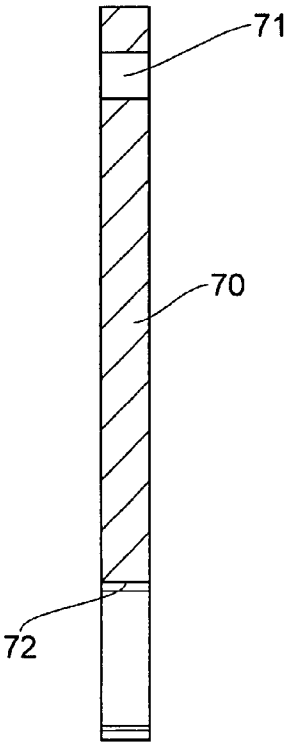
Figure 4A:
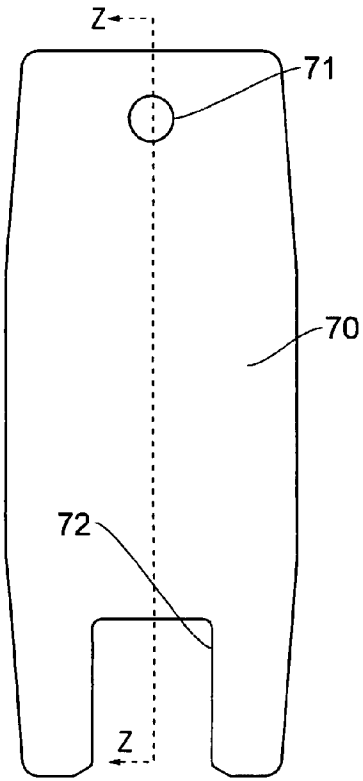

FIGS. 3A to 3E show a second railway rail fastening apparatus embodying the first and second aspects of the present invention, FIG. 3A showing a side view of the apparatus, FIG. 3B showing a cross-sectional view taken on line Y-Y in FIG. 3A, FIG. 3C shows a plan view of the apparatus, FIG. 3D shows an alternative side cross-section view taken on line Y-Y when the apparatus includes additional components, and FIG. 3E shows a perspective view of the apparatus from above; and FIGS. 4A to 4D show a shim for use in the apparatus, FIG. 4A showing a plan view of the shim from above, FIG. 4B showing a cross-sectional view taken on line Z-Z in FIG. 4A, FIG. 4C showing a plan view of the shim from below, and FIG. 4D showing an end view.

As shown in FIGS. 1A to 1D, a first railway rail fastening apparatus embodying the present invention comprises a baseplate 20 for receiving a railway rail 10 to be fastened thereto and baseplate securing means 30, 40 for securing the baseplate 20 to a baseplate seat area 2 of a concrete railway foundation 1. When the apparatus is in use, a cushioning, electrically-insulating baseplate pad 50 is located beneath the baseplate 20 on the baseplate seat area 2 of the rail foundation 1 and a cushioning, electrically-insulating rail pad 60 is located on a rail seat area 25 of the baseplate 20 beneath the rail 10. On either side of the rail seat area 25 of the baseplate 20 the baseplate 20 is provided with shoulders 21 for retaining respective resilient rail clips 22. The clips 22 carry respective toe insulators 23 to provide electrical insulation between the clip 22 and the rail 10, and sidepost insulators 24 are provided on the shoulders 22 to provide electrical insulation between the shoulder 21 and the rail 10. In this example the rail clips 22 are like those shown in EP0619852B or WO2007/096620A, which are driven laterally onto the rail foot and are approximately M-shaped in plan, and the shoulders 21 are configured appropriately, but the clips and associated shoulders may be of a different type, for example clips driven onto the rail in a direction parallel to the longitudinal axis of the rail.

Figure 1C:
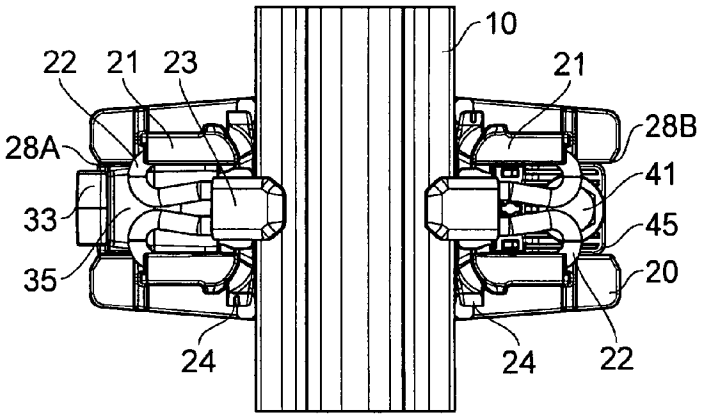
FIGS. 1A to 1D show a first railway rail fastening apparatus embodying the first and second aspects of the present invention, FIG. 1A showing a side view of the apparatus, FIG. 1B showing a cross-sectional view taken on line X-X in FIG. 1A.
Figure 1B:
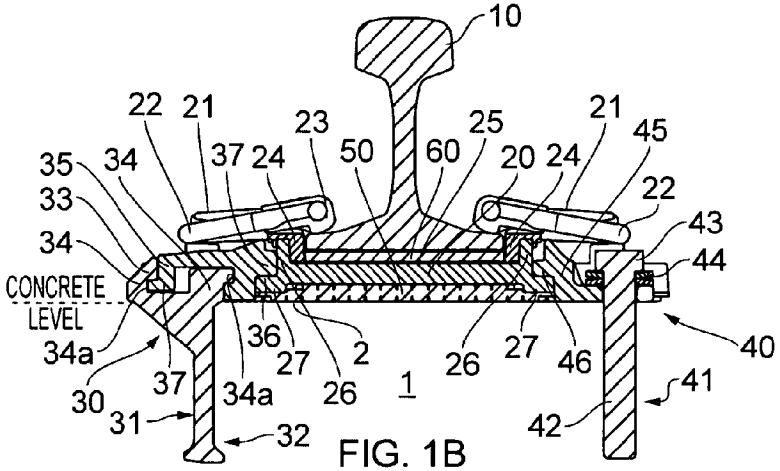
Figure 1D:
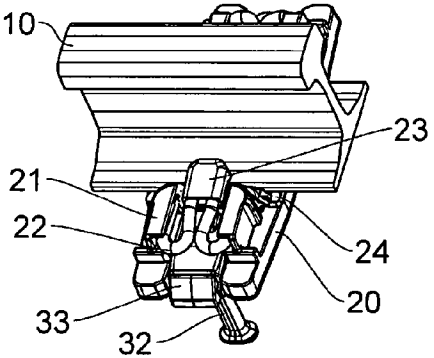
Figure 1A:
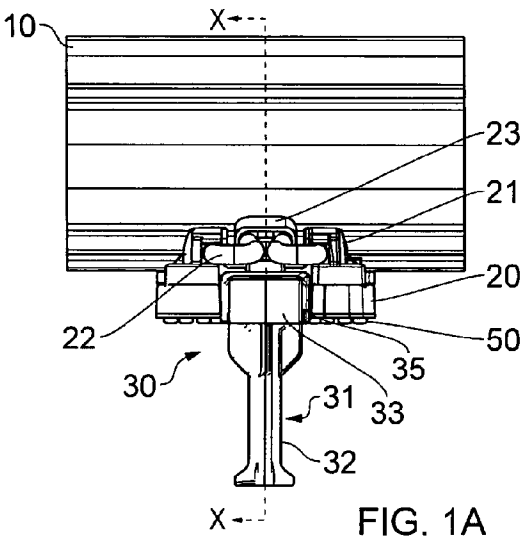
Figure 2A:
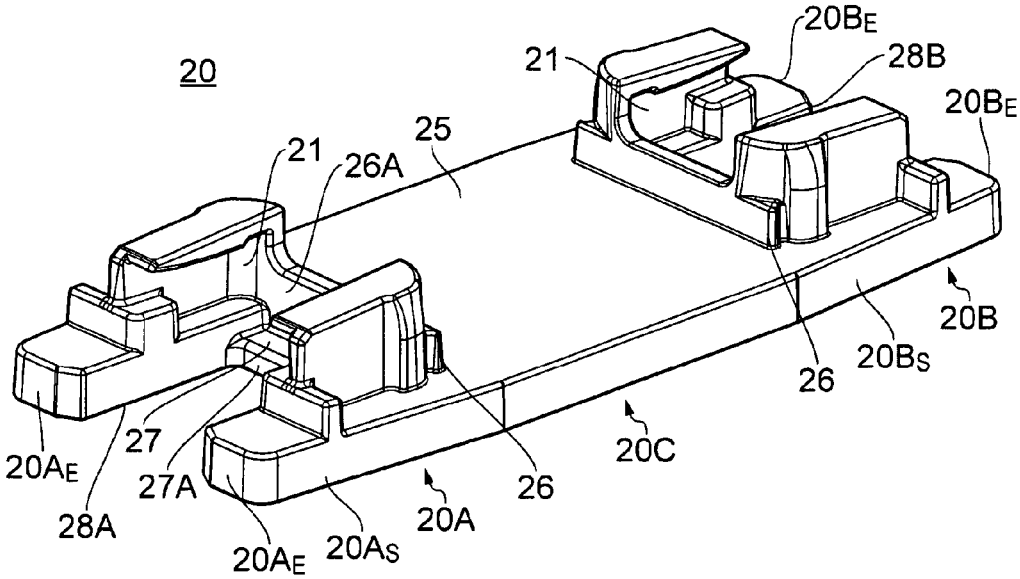
FIGS. 2A to 2C show some of the components of the apparatus shown in FIGS. 1A to 1D, FIG. 2A showing a perspective view of a baseplate, FIG. 2B showing a perspective view of a first fastening assembly, FIG. 2C showing a perspective view of a second fastening assembly, and FIGS. 2D to 2G showing respective perspective and side views of four different clamping means in a set.

As shown in FIG. 2A, the baseplate 20 is shaped so as to have a substantially rectangular centre portion 20C which includes the rail seat area 25, at the ends of which centre portion 20C are respective upstands 26 for locating the sidepost insulators 24. End portions 20A, 20B of the baseplate project on either side of the centre portion 20C and have side edges $\mathbf{20}A_S$, $\mathbf{20}B_S$ which are shaped with a slight curve, proceeding from the centre portion 20C to end edges $\mathbf{20}A_E$, $\mathbf{20}B_E$ of the baseplate 20, such that the width of the baseplate 20 at its end edges $\mathbf{20}A_E$, $\mathbf{20}B_E$ is a little narrower than at the centre portion 20C. The end edges $\mathbf{20}A_E$, $\mathbf{20}B_E$ of the baseplate 20 are formed with apertures 28A, 28B which extend through the thickness of the baseplate 20 and are shaped so as to accommodate the baseplate securing means 30, 40 respectively, so that, when the apparatus is viewed from above, only a small part of the baseplate securing means 30 projects outwardly further than the end edge $\mathbf{20}A_E$, and no portion of the baseplate securing means 40 projects outwardly further than the end edge $\mathbf{20}B_E$. Consequently, the footprint of the apparatus as a whole is substantially the same as that of the baseplate 20 itself. Between the edge of each aperture 28A, 28B and the adjacent upstand 26 a lip 27 is provided. The shoulders 21 for the rail clips 22 are provided on the baseplate 20 around the edges of the apertures 28A, 28B such that, when the baseplate 20 is in use, the clips 22 extend above respective ones of the first and second fastening assemblies 30, 40.

Figure 2B:
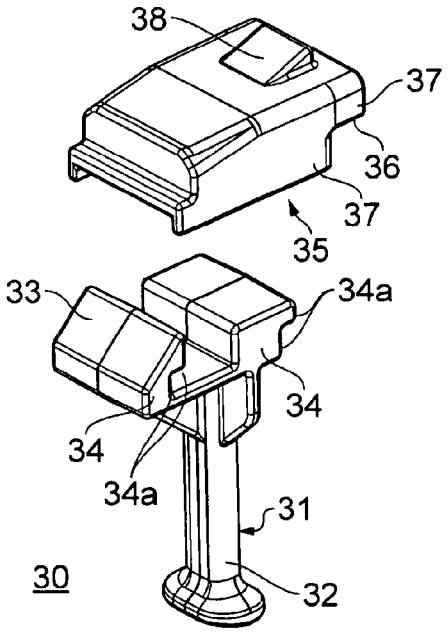
Figure 2C:
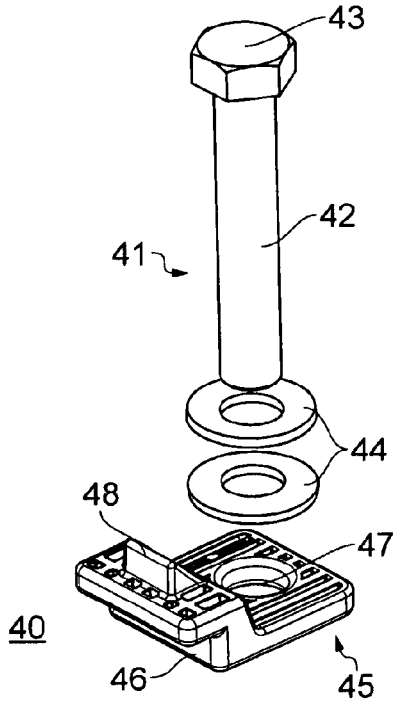
Figure 2D:
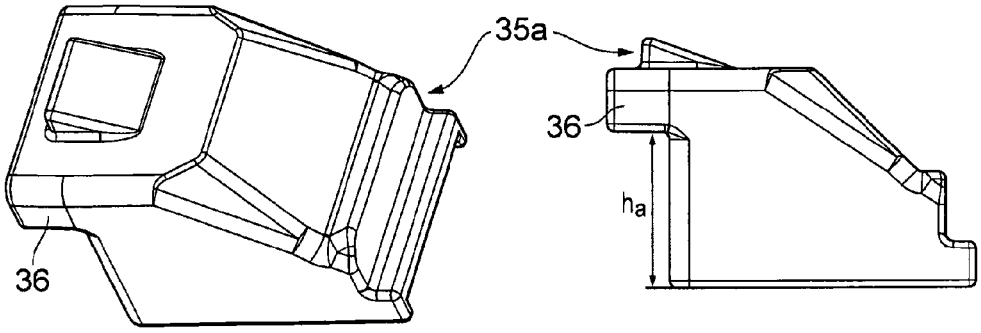
Figure 2E:
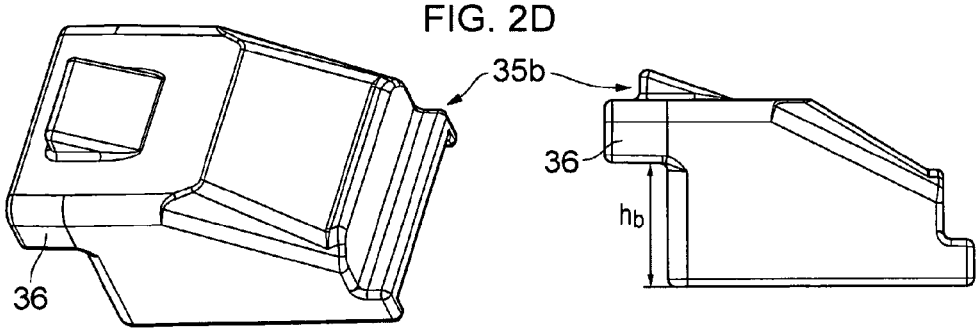
Figure 2F:
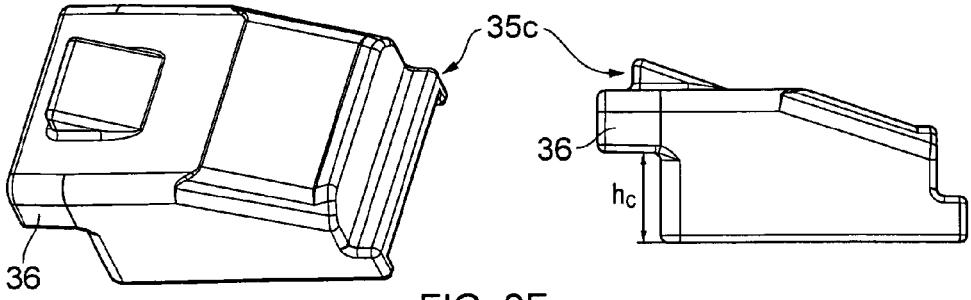
Figure 2G:
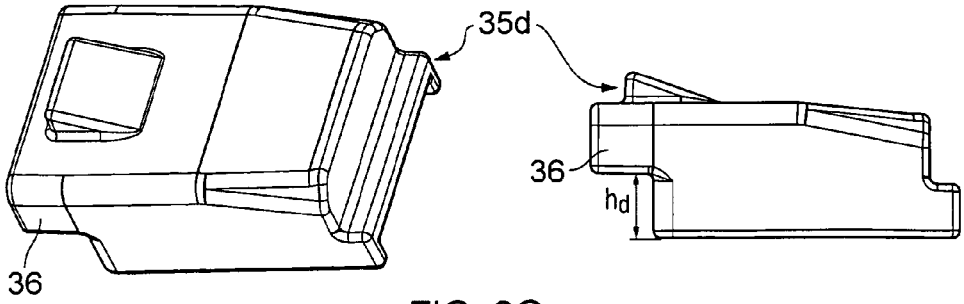

As shown in FIGS. 2B and 2C, the baseplate securing means 30, 40 comprise a first fastening assembly 30 and a second fastening assembly 40 configured for location on the concrete rail foundation on opposite sides of the baseplate seat area 2. The first and second fastening assemblies comprise respective clamping means 35, 45, which are configured such that an overhang part 36, 46 of the clamping means 35, 45 can be arranged so as to overlie the lip 27 of the baseplate 20, when the baseplate 20 is supported by the concrete rail foundation 1 in the baseplate seat area 2. The first and second fastening assemblies 30, 40 further comprise respective fixing means 31, 41 having a first part 32, 42 configured for retention within the concrete rail foundation 1 and a second part 33, 43 configured for location above the rail foundation 1 and engaging the said clamping means 35, 45.

In this embodiment, the fixing means 31 of the first fastening assembly 30 comprise a shoulder, the stem of the shoulder forming the first part 32 and being embedded in the concrete rail foundation 1, and the head of the shoulder above the rail foundation forming the second part 33 and being configured so as to interlock with and retain the clamping means 35. As an alternative (not shown) the shoulder might be of the hook-in type, the stem thereof being shaped so as to interlock with retaining features provided within an aperture in the concrete rail foundation in such a way as to allow the shoulder to be able to withstand lateral loads but be removable from the rail foundation 1 as required.

The fixing means 41 of the second fastening assembly 40 in this embodiment comprise a screw-threaded fastener, such as a bolt, the shank 42 (not shown with screw-threading) of which engages a threaded aperture (not shown) in the rail foundation 1 and extends through an opening 47 in the clamping means 45. The head 43 of the screw-threaded fastener 41 bears on the clamping means 45 through washers 44.

The clamping means 35, 45 in this embodiment are formed on an upper surface thereof with a ramp 38, 48 for assisting driving of a clip 22 into the adjoining shoulder 21.

In the prior art apparatus the baseplate is held down at both ends either by clamping means secured by screw-threaded fasteners such as bolts or screwspikes or by resilient rail clips retained by shoulders cast into the concrete slab track. According to this embodiment of the present invention, the fixing means 31 of the first fastening assembly 30 is of a different type to the fixing means 41 of the second fastening assembly 40. In particular, in this embodiment, only the fixing means 41 of the second fastening assembly 40 consists of a screw-threaded fastener.

In this embodiment of the present invention, the fixing means 31 of the first fastening assembly 30 has bearing parts 34 having respective upright planar load bearing faces 34*a* through which load is transmitted from the baseplate 20 to the fixing means 31 when the apparatus is in use. In particular, in this embodiment, the shoulder 31 is adapted to retain the clamping means 35 such that, when the apparatus is in use, a bearing part 37 of the clamping means 35 is interposed between an upright bearing face 34*a* of the shoulder 31 and upright end faces 26A, 27A of the baseplate 20, interfaces between the bearing part 37 of the clamping means 35 and the end faces 26A, 27A of the baseplate 20, and between the bearing part 37 of the clamping means 35 and the bearing face 34*a* of the shoulder 31, being planar. When a rail foundation for use with the apparatus is installed in track, the end of the rail foundation 1 having the fixing means 31 is placed at the field side of the track, so that lateral loads from the baseplate 20 will be transmitted to the rail foundation 1 through the planar interfaces of the clamping means 35 and shoulder 31.

It is sometimes desirable to provide the facility to adjust the height of the apparatus. In this case a set of clamping means 35 (desirably made of plastics material) may be provided, each clamping means 35 in the set being configured to be retained by the shoulder 31 but having an overhang part 36 at a different height, such as the set 35*a* to 35*d* shown in FIGS. 2D to 2G with respective overhang heights $h_a$ to $h_d$. A set of shims of different thicknesses (not shown, but similar or identical in shape to the shim 70 shown in FIGS. 4A to 4D) is also provided for insertion beneath the baseplate 20. To adjust the height, the clamping means 35 in the shoulder 31 is removed and replaced by another one in the set having an overhang height appropriate to the new height of the apparatus. It is not necessary to provide different clamping means 45 for the second fastening assembly, since the fixing means 41 can be removed from the apparatus fairly readily to allow insertion of one of the shims of an appropriate height beneath the baseplate 20 and then re-inserted into the threaded aperture in the rail foundation 1 through an appropriately located hole in the shim. This form of height adjustment allows a comparatively simple and inexpensive assembly to be employed initially, at the relatively small additional cost of having to discard clamping means on the relatively rare occasions when height adjustments are made. Rather than providing a large number of clamping means with different overhang heights, it may be preferable to provide a smaller number of clamping means with bigger steps, plus a number of additional compensating shims. For example, to provide 27 mm total height adjustment, three clamping means with offsets of 9 mm, 18 mm, and 27 mm and spacers ranging between 1 mm and 8 mm in depth could be provided.

Alternatively, as shown in FIGS. 3A to 3E, a second railway rail fastening apparatus embodying the present invention can provide height adjustment more easily by adding some additional components in the initial apparatus. For conciseness, those components of the apparatus which are identical to those of the first apparatus will be referred to by the same reference numerals and will not be described again.

The second railway rail fastening apparatus includes a set of clamping parts $35_1$ to $35_N$ with overhang parts $36_1$ to $36_N$ respectively of different heights (FIGS. 3A to 3C and 3E showing the clamping part $35_1$ and FIG. 3D showing the clamping part $35_N$) for retention by fixing means 31' which functions in essentially the same way as the fixing means 31 of the first apparatus. However, the interlocking parts of the fixing means 31 and clamping parts $35_1$ to $35_N$ are slightly different in design to those of the first apparatus, and so the clamping means of the first fastening assembly 30 further comprises first intermediate portions, comprising removable first intermediate buffer pads 35A, which are provided to prevent movement of the clamping parts $35_1$ to $35_N$ within the second part 33' of the fixing means 31', and second intermediate portions, comprising a set of removable second intermediate buffer pads $35B_1$ to $35B_N$, each such pad having a first portion for location between a first end face 26A of the baseplate 20 and the clamping parts $35_1$ to $35_N$ and a second portion for location between a second end face 27A of the baseplate 20 and the second part 33' of the fixing means 31'. The design of the interlocking parts of the fixing means 31 and clamping parts $35_1$ to $35_N$ and provision of the intermediate buffer pads makes the apparatus easier to disassemble in track without the need to move the rail when height adjustment is required. The second railway fastening apparatus also includes a set of shims $70_1$ to $70_{N-1}$ (only one of which is shown) of different thicknesses for insertion beneath the baseplate 20, as shown in FIG. 3D and FIGS. 4A to 4D. Each shim 70 has a hole 71 at one end through which the fixing means 41 is inserted into the rail foundation 1 and an aperture 72 at the other end for accommodating the fixing means 31'.

Some lateral adjustment of the baseplate (typically +/−5 mm) can also be achieved, for example by providing spacers that vary in width (as well as depth) or, more simply, by replacing the sidepost insulators with those having a greater or smaller thickness as required.

In order to speed up the track construction process, rail fastening apparatus embodying the present invention may be built up on pre-cast concrete units (blocks, sleepers, or slabs) before being delivered to the track construction site.

The invention claimed is:

1. A railway rail fastening apparatus comprising a baseplate for receiving a railway rail to be fastened thereto and baseplate securing elements to secure the baseplate to a baseplate seat area of a concrete railway foundation, the baseplate securing elements including first and second fastening assemblies configured for location on the concrete rail foundation on opposite sides of the baseplate seat area, each fastening assembly including clamping members configured such that a part of at least one of the clamping members can be arranged so as to overlie a portion of the baseplate, when the baseplate is supported by the concrete rail foundation and is located in the baseplate seat area thereof, each of the first and second fastening assemblies further including a fixing member having a first part configured for retention within the concrete rail foundation and a second part configured for location above the rail foundation and for engaging a respective clamping member;

wherein, of the fixing members of the first and second fastening assemblies, only the fixing member of the second fastening assembly includes a screw-threaded fastener.

2. Apparatus as in claim 1, wherein the fixing member of the first fastening assembly has a bearing part with a planar load bearing face through which load is transmitted from the baseplate to the fixing member of the first fastening assembly when the apparatus is in use.

3. Apparatus as claimed in claim 1, wherein:

a bearing part of the clamping member of the first fastening assembly is interposed between an upright face of the second part of the fixing member of the first fastening assembly and an upright end face of the baseplate; and there are interfaces between the bearing part of the clamping member and the upright end face of the baseplate and between the bearing part of the clamping member and the upright face of the second part of the fixing member through which load is transmitted from the baseplate to the fixing member of the first fastening assembly when the apparatus is in use and these interfaces are planar.

4. Apparatus as in claim 1, wherein the said clamping members are made of plastic material.

5. Apparatus as in claim 1, further comprising at least one additional clamping member for the first fastening assembly having a part for overlying the baseplate located at a different height relative to a corresponding part of said clamping member with said additional clamping member installable in the apparatus in place of said clamping member.

6. Apparatus as in claim 1, wherein the clamping member of the first fastening assembly comprises a clamping part, a first intermediate portion for location between the clamping part and an interior portion of the second part of the respective fixing member, and a second intermediate portion for location between the clamping part and the baseplate.

7. Apparatus as in claim 1, further comprising at least one additional clamping part for the first fastening assembly having a region that overlays the baseplate located at a different height to the corresponding part of the said clamping part for installation in the apparatus in place of the said clamping part.

8. Apparatus as in claim 7, further comprising at least one additional second intermediate portion, at least one dimension of which differs from that of said second intermediate portion, for installation in the apparatus in place of said second intermediate portion.

9. Apparatus as in claim 1 wherein the fixing member of the first fastening assembly comprises a shoulder.

10. A railway rail fastening apparatus comprising a baseplate for receiving a railway rail to be fastened thereto and baseplate securing means for securing the baseplate to a baseplate seat area of a concrete railway foundation, the baseplate securing means comprising first and second fastening assemblies configured for location on the concrete rail foundation on opposite sides of the baseplate seat area, each fastening assembly comprising clamping means configured such that a part of the clamping means can be arranged so as to overlie part of the baseplate, when the baseplate is supported by the concrete rail foundation and is located in the baseplate seat area thereof, each of the first and second fastening assemblies further comprising fixing means having a first part configured for retention within the concrete rail foundation and a second part configured for location above the rail foundation and for engaging the said clamping means;

wherein, of the fixing means of the first and second fastening assemblies, only the fixing means of the second fastening assembly includes a screw-threaded fastener.

11. Apparatus as in claim 10, wherein the fixing means of the first fastening assembly has a bearing part having a planar load bearing face through which load is transmitted from the baseplate to the fixing means of the first fastening assembly when the apparatus is in use.

12. Apparatus as in claim 10, wherein:

a bearing part of the clamping means of the first fastening assembly is interposed between an upright face of the second part of the fixing means of the first fastening assembly and an upright end face of the baseplate; and there are interfaces between the bearing part of the clamping means and the upright end face of the baseplate and between the bearing part of the clamping means and the upright face of the second part of the fixing means through which load is transmitted from the baseplate to the fixing means of the first fastening assembly when the apparatus is in use and these interfaces are planar.

13. Apparatus as in claim 10, wherein the said clamping means are formed of plastic material.

14. Apparatus as in claim 10, further comprising at least one additional clamping means for the first fastening assembly having a part for overlying the baseplate located at a different height to that part of the first-mentioned clamping means for installation in the apparatus in place of the first-mentioned clamping means.

15. Apparatus as in claim 10, wherein the clamping means of the first fastening assembly comprises a clamping part, a first intermediate portion for location between the clamping part and an interior portion of the second part of the fixing means, and a second intermediate portion for location between the clamping part and the baseplate.

16. Apparatus as in claim 15, further comprising at least one additional clamping part for the first fastening assembly having a part for overlying the baseplate located at a different height to that part of the first-mentioned clamping part for installation in the apparatus in place of the first-mentioned clamping part.

17. Apparatus as in claim 16, further comprising at least one additional second intermediate portion, at least one dimension of which differs from that of the first-mentioned second intermediate portion, for installation in the apparatus in place of the first-mentioned second intermediate portion.

18. Apparatus as in claim 10, wherein the fixing means of the first fastening assembly includes a shoulder.

19. A railway rail fastening apparatus comprising:

a baseplate with first and second spaced apart ends, and with a central rail receiving region between the ends;

first and second different fixing members each of which is carried by the baseplate adjacent to a respective end, the fixing members extend laterally from the baseplate, relative to the rail receiving region, wherein a height adjusting clamp is carried by only one of the fixing members, and where a different clamp is carried by the other fixing member and where the clamps each carry a rail clip guiding ramp;

wherein the height adjusting clamp is selected from a plurality of similarly shaped clamps where the members of the plurality each have a different height adjusting parameter.

* * * * *